US008269808B2

(12) United States Patent
Matsutani

(10) Patent No.: US 8,269,808 B2
(45) Date of Patent: Sep. 18, 2012

(54) PRINTER

(75) Inventor: Megumi Matsutani, Aichi (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 301 days.

(21) Appl. No.: 12/724,893

(22) Filed: Mar. 16, 2010

(65) Prior Publication Data

US 2010/0302339 A1 Dec. 2, 2010

(30) Foreign Application Priority Data

May 28, 2009 (JP) ..... 2009-129060

(51) Int. Cl.
*B41J 2/315* (2006.01)
*B41J 2/325* (2006.01)

(52) U.S. Cl. ..... 347/171; 347/215

(58) Field of Classification Search ..... 347/171, 347/215, 217, 218
See application file for complete search history.

(56) References Cited

U.S. PATENT DOCUMENTS

| | | | | |
|---|---|---|---|---|
| 5,331,340 | A | 7/1994 | Sukigara | |
| 6,042,284 | A | 3/2000 | Yanagisawa et al. | |
| 2006/0087523 | A1 * | 4/2006 | Horsnell et al. | 347/5 |
| 2009/0106283 | A1 | 4/2009 | Tanjima et al. | |

FOREIGN PATENT DOCUMENTS

| | | |
|---|---|---|
| EP | 1582363 | 10/2005 |
| JP | 60165270 | 8/1985 |
| JP | 7214814 | 8/1995 |
| JP | 2000-259617 | 3/1999 |
| JP | 2009-015756 | 7/2007 |

* cited by examiner

*Primary Examiner* — Huan Tran
(74) *Attorney, Agent, or Firm* — McCarter & English, LLP

(57) ABSTRACT

In the case where printing density is set to 180 dpi and temperature of a thermal head is under t5, low-density dot-expanding printing is carried out wherein a dot occupying two printing lines for 360 dpi is formed and thermally transferred onto a surface tape by conveying the surface tape and an ink ribbon by two printing lines for 360 dpi in a single printing cycle with heater elements to be used for printing based one line of line printing data being heated.

4 Claims, 11 Drawing Sheets

INK RIBBON
SURFACE TAPE
33
81
82
31

42
41
21

83

DOUBLE TAPE
36
86
84
85

38
39
22

PRINTER

CROSS REFERENCE TO RELATED APPLICATIONS

The present application claims priority from Japanese Patent Application No. JP 2009-129060, which was filed on May 28, 2009, the disclosure of which is incorporated herein by reference in its entirety.

TECHNICAL FIELD

The disclosure relates to a thermal transfer printer wherein, for printing, ink in an ink layer of an ink ribbon is transferred onto a printing medium by using a thermal head.

BACKGROUND

Regarding printers for printing onto a printing medium, there have conventionally been known printers that employ a thermal head as printing means thereof, as well as ink-jet printers and laser printers. The printers with a thermal head are easy for miniaturization and price-reduction in comparison with the ink-jet printers and the laser printers. Therefore, the printers with a thermal head are used for tape printing apparatuses so as to print letters and figures on a tape fed from a tape cassette housed therein, for instance.

As variations of printers with a thermal head as printing means, there have been used heat-sensitive printers that carry out printing onto heat-sensitive paper and thermal transfer printers wherein, for printing, ink in an ink layer of an ink ribbon is transferred onto a printing medium by using a thermal head. Particularly, the thermal transfer printers are superior to the heat-sensitive printers in terms of that quality of printing by the thermal transfer printers is hard to deteriorate even after passage of long time in comparison with quality of printing by the heat-sensitive printers and that discoloration of a printing medium can be avoided in case of thermal transfer printers.

Furthermore, there has conventionally been required for the printers with a thermal head to print quickly so as to shorten printing time. Thermal transfer printers, however, have caused problems as will be described below in case of quick printing.

FIG. 11 shows an example of an energization waveform with respect to a heater element of a thermal head in a thermal transfer printer and a heating pattern thereof. A heat transfer printer includes a thermal head, used as printing means, consisting of a plurality (e.g. 128 or 256) of heater elements aligned crosswise with respect to a conveying direction of a printing medium. Once printing is started, one line of printing data (line printing data) is transferred to the thermal head from a control unit. Thereafter, heater elements to be used for printing based on the transferred printing data are electrically energized as the waveform shown in FIG. 11 indicates. It is to be noted that an energization waveform consists of: "preheating 1" for compensating thermal capacity shortage of a thermal head at initial stage of printing; "preheating 2" for raising temperature up to predetermined temperature (referred to as ink-melting temperature, hereinafter) so that a heater element to be used for printing is heated enough for thermal transfer (i.e., temperature hot enough to melt an ink layer of an ink ribbon); and "heating" for constantly keeping temperature of the heater element to be used for printing at the ink-melting temperature). Thermal transfer based on one line of printing data is carried out as single printing cycle.

Heater elements are energized, as the waveform of FIG. 11 indicates, whereby the heater elements are heated up to the ink-melting temperature or higher and ink of an ink layer is transferred onto a printing medium in dot shape with respect to each of the heated heater elements. By repeating the above-described one line of thermal transfer and conveyance of the printing medium, desired letters and figures are printed on the printing medium. For improving printing speed, it is necessary to shorten a printing cycle of one line of printing, in other words, shorten time to energize a heater element.

However, shortening of energization time means that the same heat quantity has to be applied to a heater element within a short time. This manner has required high power and increased burden to a CPU. Since printers with a thermal head have often been adapted to the as-mentioned compact and simple structured apparatuses, high-powered design and installation of a high performance CPU have been hard to put into practice. There has been devised a conventional heat transfer printer that thins out some dots for quick printing.

In the conventional printer, quick printing is realized by thinning out some dots, i.e., reducing the number of lines for printing. Therefore, an empty space arises between printed dots 151 as shown in FIG. 12. Consequently, edge portions of printed letters and figures are considerably rough, which degrades printing quality.

SUMMARY

The disclosure has been made to solve the above-described problem. Given that letters and figures are formed with thermally transferred dots that occupy plural lines by a printer with a thermal head, the disclosure has an object to provide a thermal transfer printer capable of realizing quick printing without requiring high-powered design and installation of a high performance CPU and preventing printing quality from degrading considerably at the time of quick printing.

To achieve the purpose of the disclosure, there is provided a printer comprising: an ink ribbon that includes an ink layer; a conveyer unit that conveys a printing medium and the ink ribbon at predetermined conveying speed; a thermal head that consists of a plurality of heater elements aligned thereon in contact with the ink ribbon, heats up heater elements electrically energized and transfers the ink layer of the ink ribbon directed to positions of the heater elements electrically energized onto the printing medium; a printing data creator unit that creates printing data; a printing data divider unit that divides printing data created by the printing data creator unit into plural lines of line printing data specifying to-be-energized heater elements and not-to-be-energized heater elements with respect to the plurality of heater elements; a data transferor unit that transfers one line of the line printing data to the thermal head; and a line printing controller unit that controls the conveyer unit to convey the printing medium and the ink ribbon by plural lines while the heater elements electrically energized in accordance with the line printing data transferred by the data transferor unit are in a heated state, wherein processes by the data transferor unit and the line printing controller unit is repeatedly executed with respect to all the plural lines of the line printing data divided by the printing data divider unit so as to carry out printing on the printing medium based on the printing data.

DETAILED DESCRIPTION

A detailed description of an exemplary embodiment of a tape printing apparatus 1 embodying a printer directed to the disclosure will now be given referring to the accompanying drawings, the tape printing apparatus 1 carrying out printing on a tape fed from a tape cassette.

First, the schematic structure of the tape printing apparatus 1 directed to the present embodiment will be described by referring to drawings.

Figure 1:
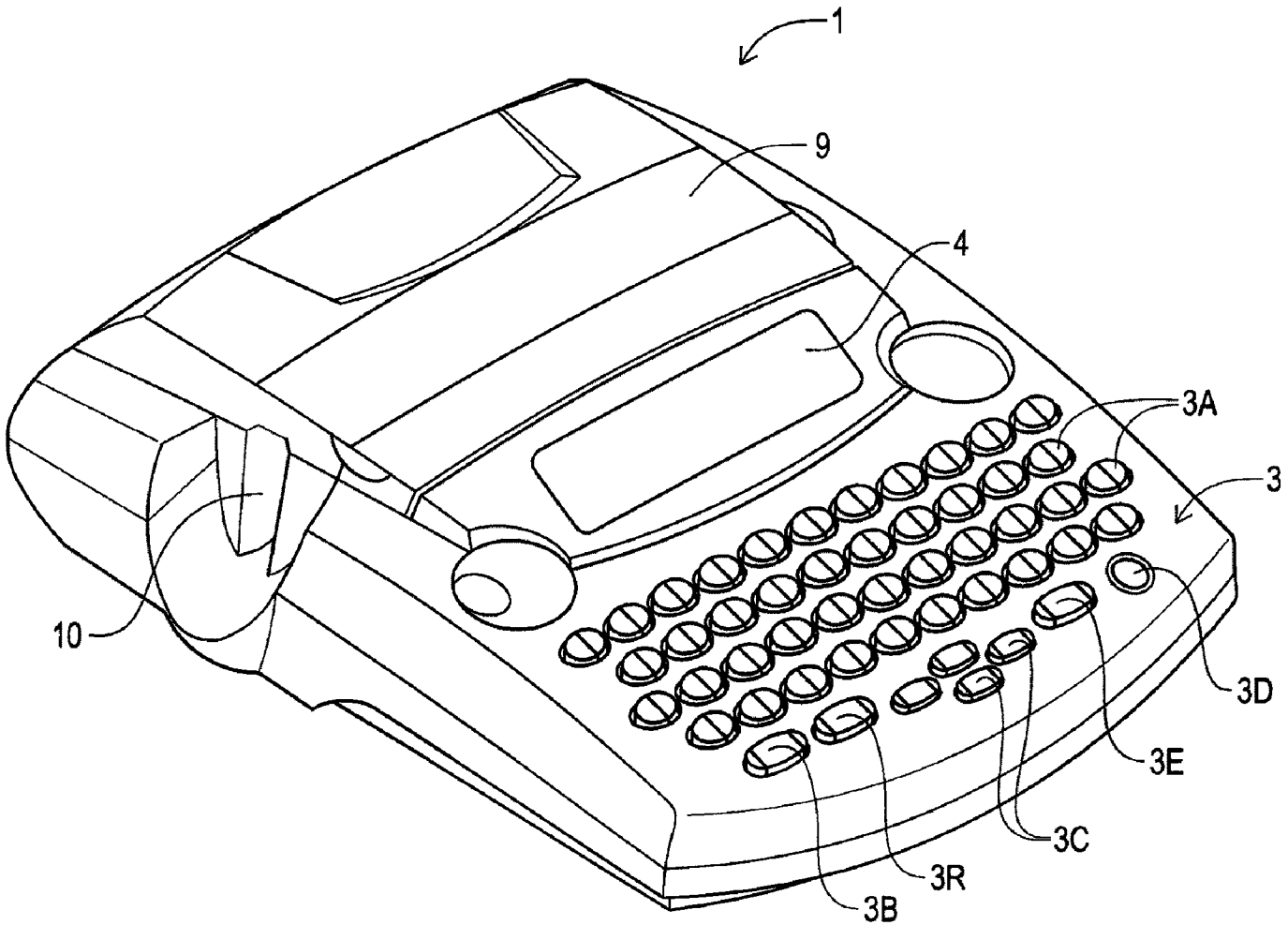
FIG. 1 is a perspective view of a tape printing apparatus directed to an embodiment.

As shown in FIG. 1, the tape printing apparatus 1 directed to the present embodiment is a printer for carrying out printing on a tape fed from a tape cassette 5 (refer to FIG. 2) housed inside a cabinet of the printing apparatus 1. The tape printing apparatus 1 includes a keyboard 3 and a liquid crystal display 4 on the top of the cabinet. Further, a cassette holding portion 8 for holding the tape cassette 5 that is a rectangular shape when seen from top is loaded inside the cabinet from a top portion thereof and covered by a housing cover 9. Beneath the keyboard 3, a control board (not shown) constituting a control circuit portion is arranged. A tape ejecting portion 10 for ejecting a printed tape is formed at the left side of the cassette holding portion 8. Further, a connection interface (not shown) is arranged at the right side of the tape printing apparatus 1. The connection interface is used for connecting the tape printing apparatus 1 to an external apparatus (e.g., a personal computer, etc.) in a manner of either wireline connection or wireless connection. Accordingly, the tape printing apparatus 1 is capable of printing out printing data transmitted from an external apparatus.

The keyboard 3 includes plural operation keys such as letter input keys 3A, a print key 3B, cursor keys 3C, a power key 3D, a setting key 3E, a return key 3R, etc. The letter input keys 3A are operated for inputting letters that create texts consisting of document data. The print key 3B is operated for commanding to print out printing data consisting of created texts, etc. The cursor keys 3C are operated for moving a cursor being indicated in the liquid crystal display 4 up, down, left or right. The power key 3D is operated for turning on or off the power of the main body of the tape printing apparatus 1. The setting key 3E is operated for setting various conditions (setting of printing density and the like). The return key 3R is operated for executing a line feeding instruction or various processing and for determining a choice from candidates.

The liquid crystal display 4 is a display device for indicating characters such as letters, etc. in plural lines, i.e., displaying printing data created by the keyboard 3.

Figure 2:
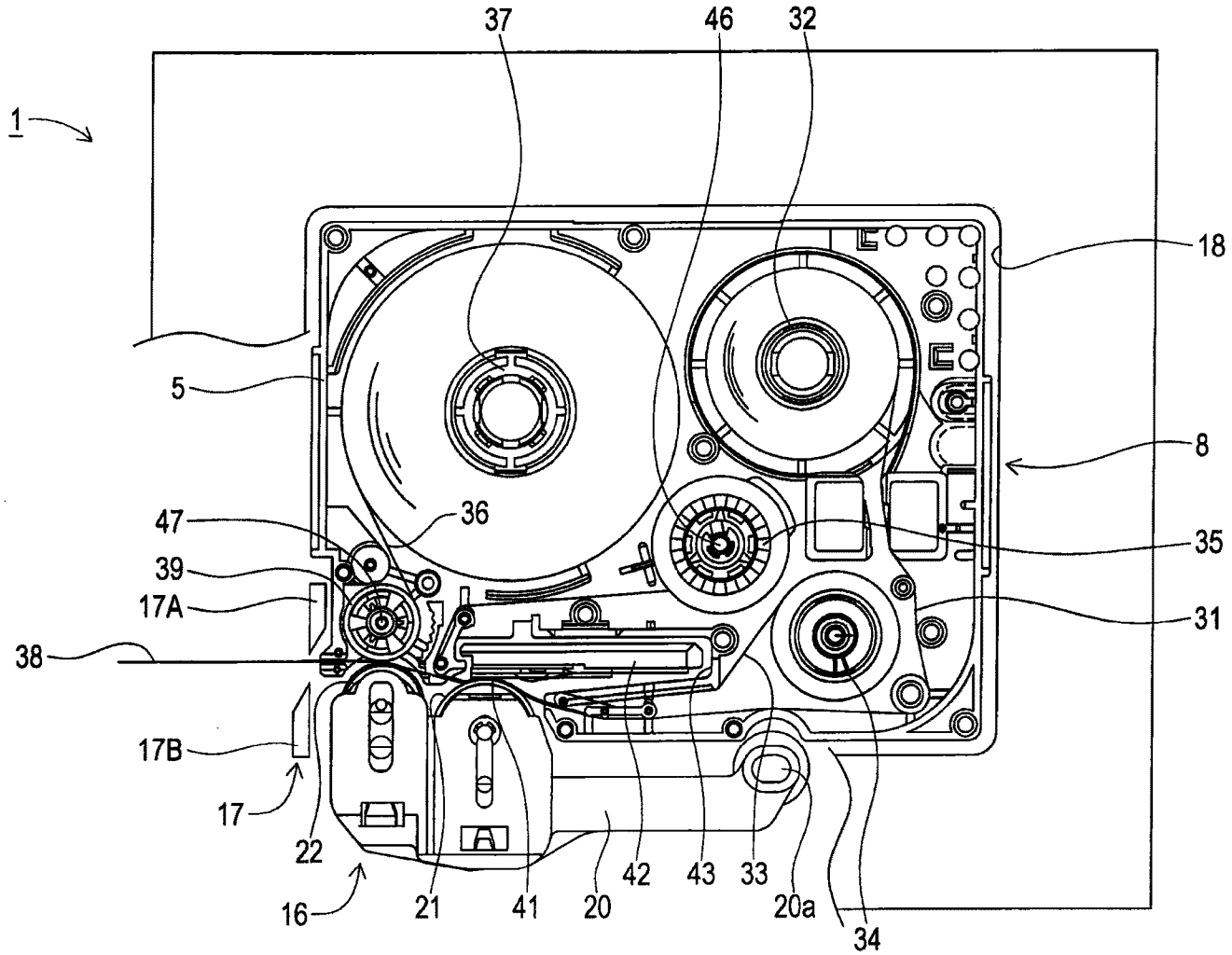
FIG. 2 is a top plan view showing a vicinity of a cassette holding portion for the tape printing apparatus directed to the embodiment.
Figure 3:
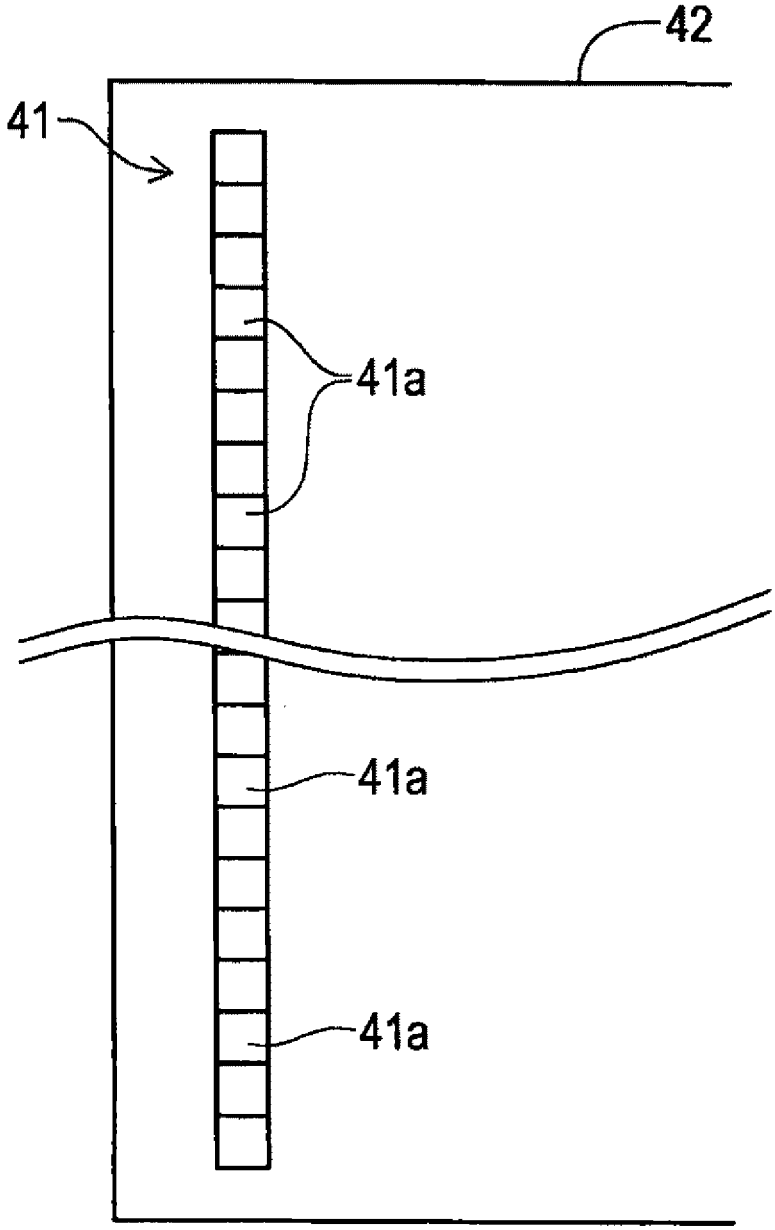
FIG. 3 is an enlarged diagram of a thermal head for the tape printing apparatus directed to the embodiment.

As shown in FIG. 2, the tape printing apparatus 1 is configured such that the tape cassette 5 can be loaded in the cassette holding portion 8 arranged inside thereof. Further, inside the tape printing apparatus 1, tape cutting mechanism including a tape driving and printing mechanism 16 and a cutter 17 is arranged. The tape printing apparatus 1 is capable of carrying out printing onto a tape fed from the tape cassette 5 by the tape driving and printing mechanism 16 in accordance with desired printing data. Further, the tape printing apparatus 1 is capable of cutting off a printed part of a tape with the cutter 17 constituting the tape cutting mechanism. The printed part of the tape thus cut off is ejected from the tape ejecting portion 10 formed on the left side of the tape printing apparatus 1.

Inside the tape printing apparatus 1, a cassette holding frame 18 is arranged. As shown in FIG. 2, the tape cassette 5 is loaded into the cassette holding frame 18 in a removable and replaceable manner.

The tape cassette 5 includes a tape spool 32, a ribbon feeding spool 34, a used-ribbon-take-up spool 35, a base-material-sheet feeding spool 37 and a bonding roller 39 in a rotatably-supported manner, inside thereof. A surface tape 31 is wound around the tape spool 32. The surface tape 31 is made of a transparent tape such as PET (polyethylene terephthalate) film or the like. An ink ribbon 33 is wound around the ribbon feeding spool 34. On the ink ribbon 33, there is applied ink that melts or sublimes when heated so as to form an ink layer. A part of the ink ribbon 33 that has been used for printing is taken up in the used-ribbon-take-up spool 35. A double tape 36 is wound around the base-material-sheet feeding spool 37. The double tape 36 is configured so as to bond the surface tape 31 and a release tape to one side and the other side of a double-sided adhesive tape wherein the double-sided adhesive tape includes adhesive agent layers at both sides thereof with width the same as width of the surface tape 31. The double tape 36 is wound around the base-material-sheet feeding spool 37 so that the release tape is located outside. The bonding roller 39 is used for bonding the double tape 36 and the surface tape 31 together.

As shown in FIG. 2, in the cassette holding frame 18, an arm 20 is arranged around a shaft 20*a* in a pivotal manner. A platen roller 21 and a conveying roller 22 are rotatably supported at the front edge of the arm 20. Both the platen roller 21 and the conveying roller 22 employ a flexible member made of rubber or the like for their surfaces.

When the arm 20 fully swings clockwise, the platen roller 21 presses the surface tape 31 and the ink ribbon 33 against a thermal head 41 to be described later. At the same time, the conveying roller 22 presses the surface tape 31 and the double tape 36 against the bonding roller 39.

A plate 42 is arranged upright inside the cassette holding frame 18. The plate 42 includes a thermal head 41 at its side surface facing the platen roller 21. The thermal head 41 consists of a plurality (e.g. 128 or 256) of heater elements 41*a* aligned in the width direction of the surface tape 31 and the double tape 36.

When the tape cassette 5 is placed in a predetermined position, the plate 42 is fitted in a concave portion 43 of the tape cassette 5.

Further, as shown in FIG. 5, a ribbon-take-up roller 46 and a bonding-roller driving roller 47 are arranged upright inside the cassette holding frame 18. When the tape cassette 5 is placed in the predetermined position, the ribbon-take-up roller 46 and the bonding-roller driving roller 47 are inserted in the used-ribbon-take-up spool 35 and the bonding roller 39 of the tape cassette 5, respectively.

In the cassette holding frame 18, there is arranged a not-shown tape conveying motor. Driving force of the tape conveying motor is transmitted to the platen roller 21, the conveying roller 22, the ribbon-take-up roller 46 and the bonding-roller driving roller 47, etc. via series of gears arranged along the cassette holding frame 18.

Accordingly, when rotation of an output shaft of the tape conveying motor is started with supply of power to the tape conveying motor, rotation of the used-ribbon-take-up spool 35, the bonding roller 39, the platen roller 21 and the conveying roller 22 is started in conjunction with the operation of the tape conveying motor. Thereby, the surface tape 31, the ink ribbon 33 and the double tape 36 in the tape cassette 5 are loosed out from the tape spool 32, the ribbon feeding spool 34 and the base-material-sheet feeding spool 37, respectively, and are conveyed in a downstream direction (toward the tape ejecting portion 10 and the used-ribbon-take-up spool 35).

Thereafter, the surface tape 31 and the ink ribbon 33 are bonded together and go through a path between the platen roller 21 and the thermal head 41 in a superimposed state. Accordingly, in the tape printing apparatus 1 of the present embodiment, the surface tape 31 and the ink ribbon 33 are conveyed with being pressed by the platen roller 21 and the thermal head 41. The significant number of the heater elements 41*a* aligned on the thermal head 41 are selectively and intermittently energized by a control unit 60 (refer to FIG. 4) in accordance with printing data and a printing control program to be described later.

Each heater element 41*a* gets heated by power supply and melts or sublimes ink applied on the ink ribbon 33. Therefore, ink in the ink layer on the ink ribbon 33 is transferred onto the surface tape 31 in a certain unit of dots. Consequently, a printing-data-based dot image desired by a user is formed on the surface tape 31 as mirror image.

After passing through the thermal head 41, the ink ribbon 33 is taken up by the ribbon-take-up roller 46. On the other hand, the surface tape 31 is superimposed onto the double tape 36 and goes through a path between the conveying roller 22 and the bonding roller 39 in a superimposed state. At the same time, the surface tape 31 and the double tape 36 are pressed against each other by the conveying roller 22 and the boding roller 39 so as to form a laminated tape 38. Of the laminated tape 38, a printed-side surface of the surface tape 31 furnished with dot printing and the double tape 36 are firmly superimposed together. Accordingly, a user can see a normal image of the printed image from the reversed side for the printed-side surface of the surface tape 31 (i.e., the top side of the laminated tape 38).

Thereafter, the laminated tape 38 is conveyed further downstream with respect to the conveying roller 22 to reach the tape cutting mechanism including the cutter 17. The tape cutting mechanism consists of the cutter 17 and the tape cutting motor 72 (refer to FIG. 4). The cutter 17 includes a fixed blade 17*a* and a rotary blade 17*b*. More specifically, the cutter 17 is a scissors-like cutter that cuts off an object to be cut off by rotating the rotary blade 17*b* against the fixed blade 17*a*. The rotary blade 17*b* is arranged so as to be able to rotate back and forth with reference to a shaft thereof with the aid of the tape cutting motor 72. Accordingly, the laminated tape 38 is cut off with the fixed blade 17*a* and the rotary blade 17*b* along operation of the tape cutting motor 72.

The laminated tape 38 thus cut off is ejected outside of the tape printing apparatus 1 via the tape ejecting portion 10. By peeling off the release paper from the double tape 36 and exposing the adhesive agent layer, the laminated tape 38 can be used as adhesive label that can be adhered to an arbitrary place. Incidentally, the mechanism of thermal transfer with the thermal head 41 will be described in detail later.

Figure 4:
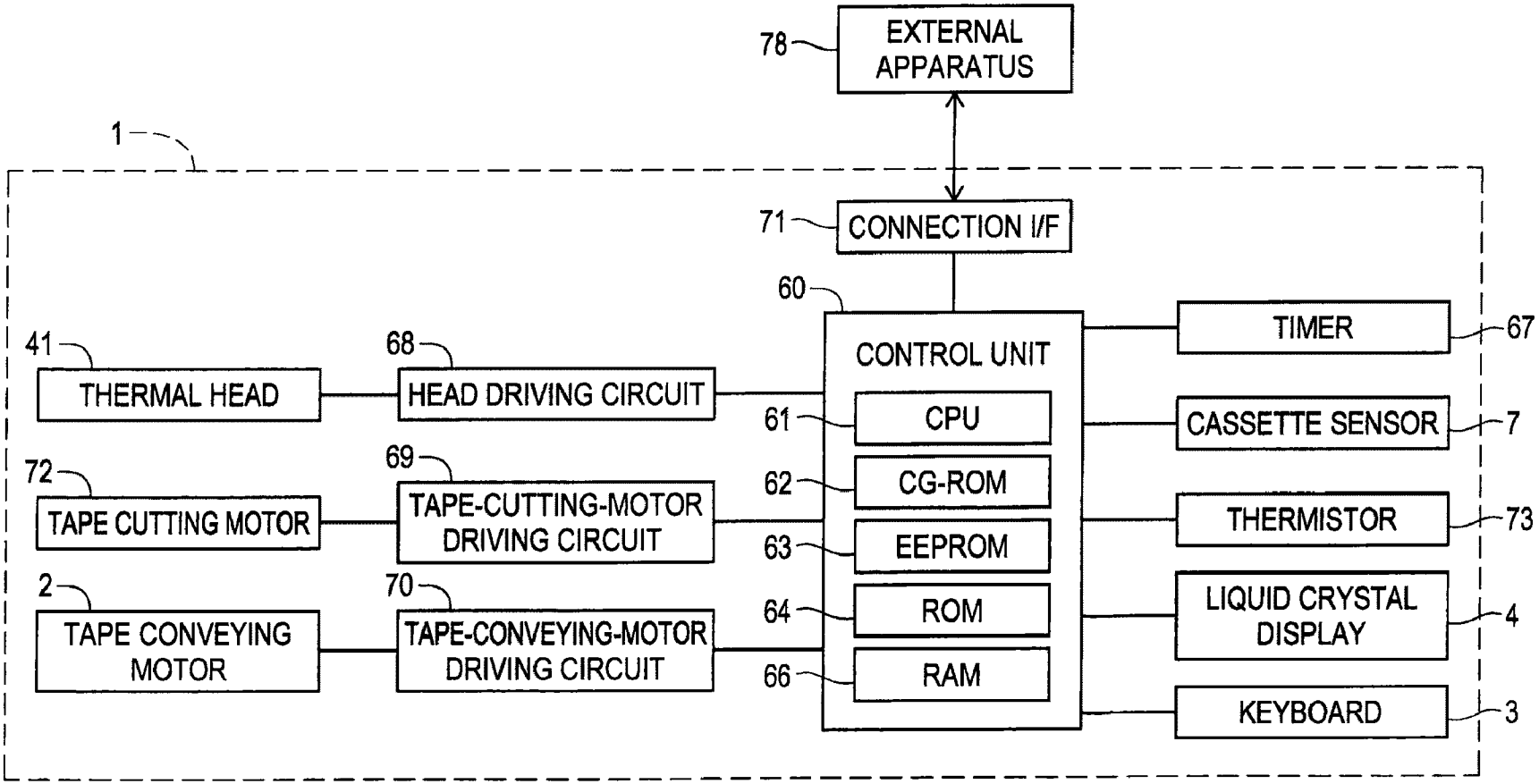
FIG. 4 is a block diagram showing control system of the tape printing apparatus directed to the embodiment.

Next, there will be described on a control configuration of the tape printing apparatus 1 by referring to drawings. Especially, FIG. 4 is a block diagram indicating a control system of the tape printing apparatus 1.

Inside the tape printing apparatus 1, there is arranged a control board (not shown) on which a control unit 60, a timer 67, a head driving circuit 68, a tape-cutting-motor driving circuit 69 and a tape-conveying-motor driving circuit 70 are arranged.

The control unit 60 consists of a CPU 61, a CG-ROM 62, an EEPROM 63, a ROM 64 and a RAM 66. Furthermore, the control unit 60 is connected to the timer 67, the head driving circuit 68, the tape-cutting-motor driving circuit 69 and the tape-conveying-motor driving circuit 70. The control unit 60 is also connected to a liquid crystal display 4, a cassette sensor 7, a thermistor 73, a keyboard and a connection interface 71.

The CPU 61 is a central processing unit that plays a primary role for various system control of the tape printing apparatus 1. Accordingly, the CPU 61 controls various peripheral devices such as the liquid crystal display 4 etc. in accordance with input signals from the keyboard 3 as well as various control programs including a printing process program to be described later.

The CG-ROM 62 is a character generator memory wherein image data of to-be-printed letters and sign are associated with code data and stored in dot patterns. The EEPROM 63 is a non-volatile memory that allows data write for storing therein and deletion of stored data therefrom. The EEPROM 34 stores data that indicates user setting etc. of the tape printing apparatus 1.

The ROM 64 stores various control programs and various data for the tape printing apparatus 1. Accordingly, the printing process program to be described later is stored in the ROM 64.

The RAM 66 is a storing device for temporarily storing a processing result of the CPU 61 etc. The RAM 66 also stores print data created with inputs by means of the keyboard 3, printing data taken therein from external apparatuses 78 via the connection interface 71.

The timer 67 is a time-measuring device that measures passage of predetermined length of time for executing control of the tape printing apparatus 1. More specifically, the timer 67 is referred for detecting start and termination of an energization period for a heater element 41*a* of the thermal head 41 in the printing process program to be described later.

Further, the thermistor 73 is a sensor that detects temperature of the thermal head 41 and attached on the thermal head 41.

The head driving circuit 68 is a circuit that serves to supply a driving signal to the thermal head 41 in response to a control signal from the CPU 61 for controlling operation manners of the thermal head 41 based on the printing process program t be described later. In this connection, the head driving circuit 68 controls to energize and de-energize each of the heater elements 41*a* based on a strobe number associated with each heater element 41*a* for comprehensively controlling heating manner of the thermal head 41. The tape-cutting-motor driving circuit 69 is a circuit that serves to supply a driving signal to the tape cutting motor 72 in response to a control signal from the CPU 61 for controlling operation of the tape cutting motor 72. Further, the tape-conveying motor driving circuit 70 is a control circuit that serves to supply a driving signal to a tape conveying motor 2 based on the control signal from the CPU 61 for controlling operation of the tape conveying motor 2.

Figures 5A, 5B, 5C, 5D, 5E:
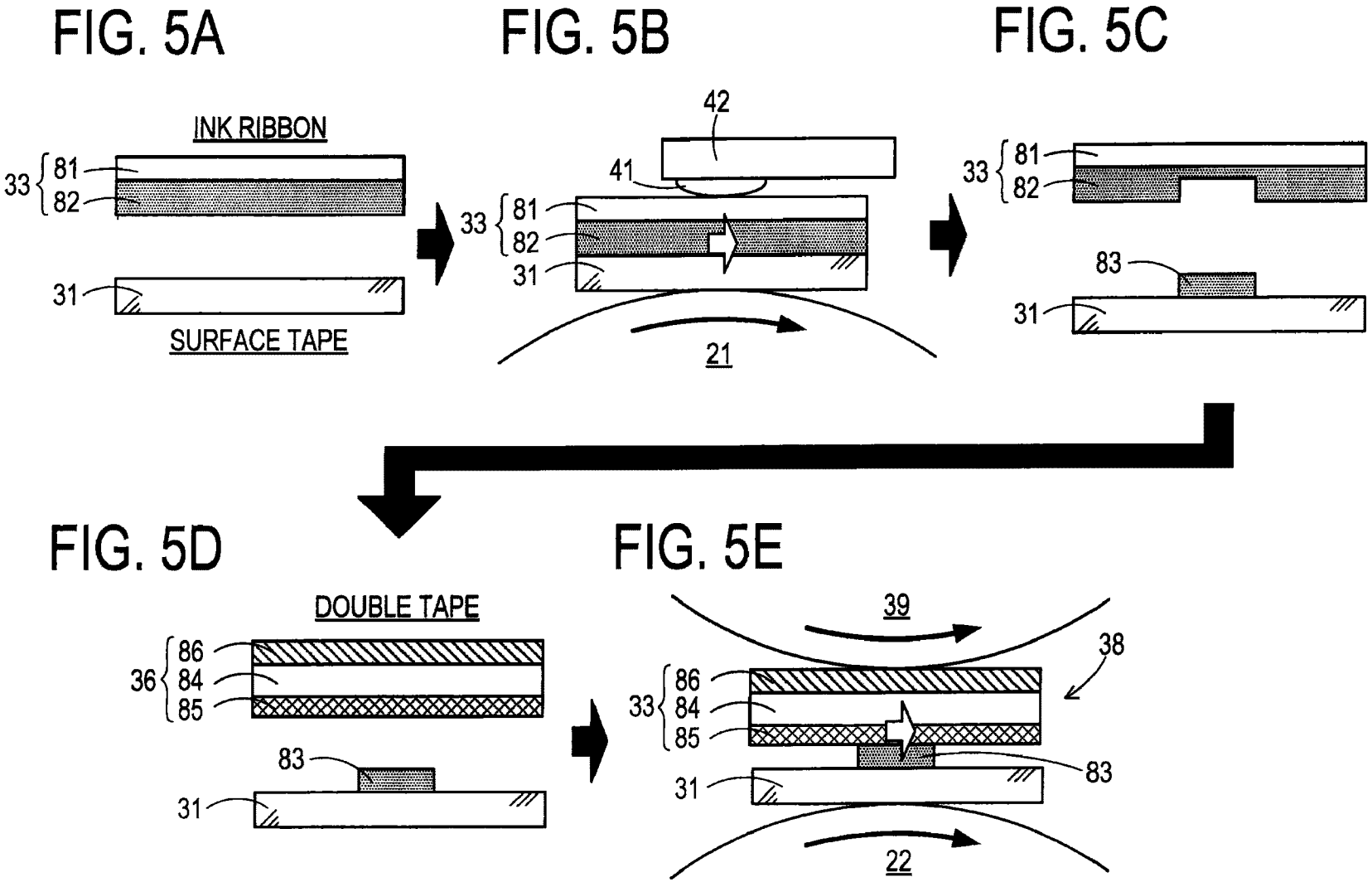
FIG. 5(A) through FIG. 5(E) are diagrams for illustrating thermal transfer with the tape printing apparatus directed to the embodiment.

Next, there will be described on the thermal transfer mechanism by employing the thermal head 41 directed to the present embodiment by referring to FIG. 5(A) through FIG. 5(E). FIG. 5(A) through FIG. 5(E) are diagrams for illustrating thermal transfer mechanism by the thermal head 41. As shown in FIG. 5(A), the ink ribbon 33 is comprised of a base film 81 and an ink layer 82. The surface tape 31 as printing medium is made of a PET film. Further, of the surface tape 31, a surface facing the ink ribbon 33 has had surface treatment so that ink is easy to adhere thereon.

As already described, the surface tape 31 loosened from the tape spool 32 is guided to reach a printing position between the thermal head 41 and the platen roller 21 along rotation of the platen roller 21, the conveying roller 22, etc. (refer to FIG. 5(A)). The surface tape 31 is superimposed with the ink ribbon 33 at the printing position so that the surface treatment side of the surface tape 31 comes in contract with the ink layer 82 of the ink ribbon 33.

Figure 11:
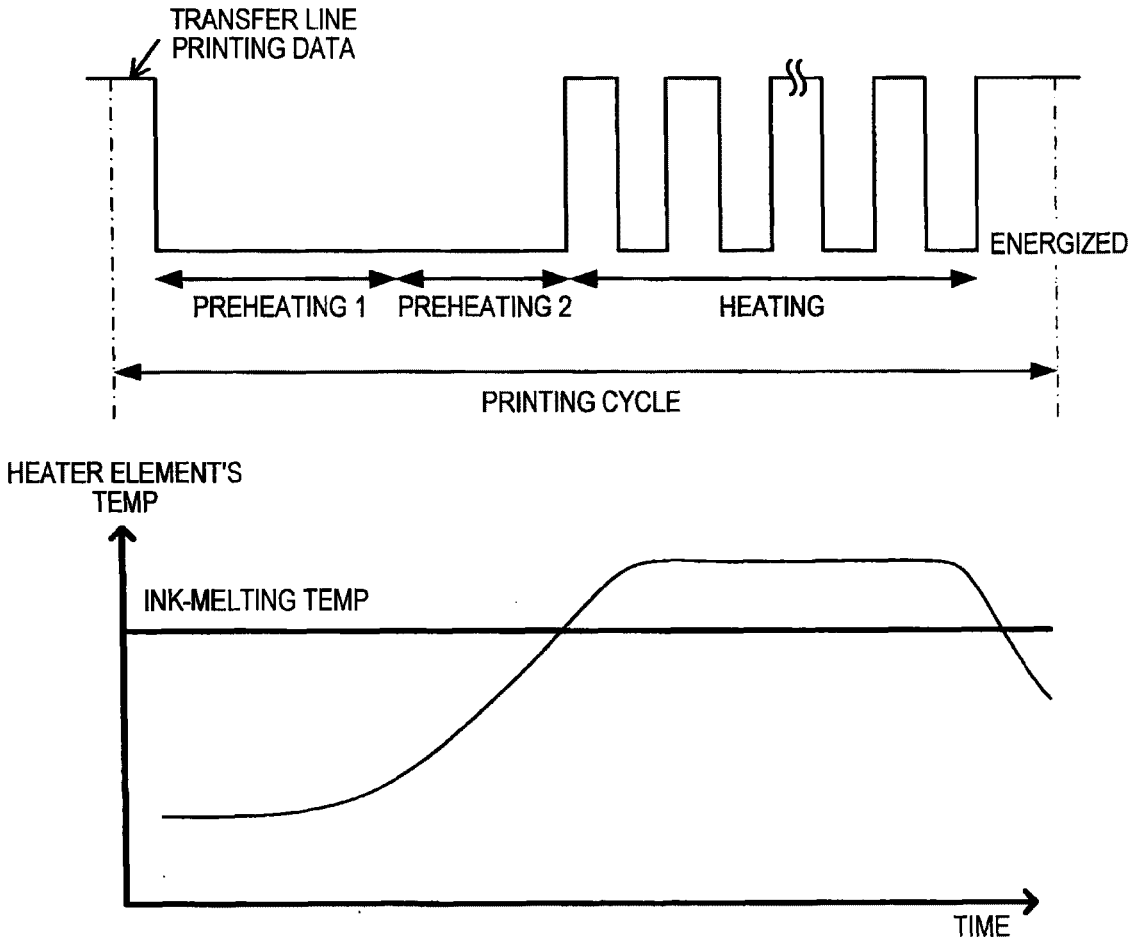
FIG. 11 is a diagram showing an example of an energization waveform with respect to a heater element of a thermal head used in a thermal transfer printer and a heating pattern thereof.
Figure 12:
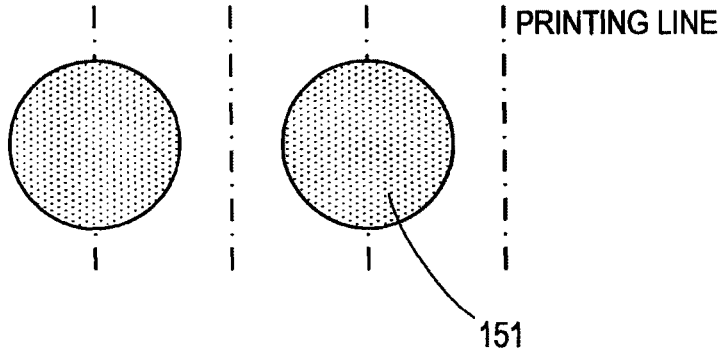
FIG. 12 (PRIOR ART)
FIG. 12 is a diagram showing a printing example of quick printing done by a conventional printer.

When the surface tape 31 and the ink layer 82 of the ink ribbon 33 come in contact with each other, the contact portion of them is pressed with the thermal head 41 and the platen roller 21 (refer to FIG. 5(B)). The thermal head 41 comes in contact with one side of the base film 81 (the reverse side of the surface where the ink layer 82 is formed). One line of printing data is transferred to the thermal head 41 and heater elements 41*a* to be used for printing based on the transferred one line of printing data are electrically energized. It is to be noted that an energization waveform as shown in FIG. 11 is the waveform obtained when a heater element 41*a* is electrically energized. A heater element 41*a* electrically energized is heated up to ink-melting temperature (e.g., 90-degree) that is hot enough to melt ink of the ink layer 82. Consequently, of the ink layer 82 on the ink ribbon 33, a part of the ink in contact with the thermal head 41 melts due to heat of the thermal head 41. Thereafter, melted ink in the ink layer 82 is adhered onto the surface tape 31. Subsequently, by releasing the ink ribbon 33 from the surface tape 31, only the adhered ink 83 is transferred onto the surface tape 31 as one line of dots (refer to FIG. 5(C)). The ink ribbon 33 with the remaining ink layer 82 no longer used is taken up by the used-ribbon-take-up spool 35 as consumed ink ribbon 33.

The above-described thermal transfer process is repeatedly carried out by one line while the surface tape 31 and the ink ribbon 33 are conveyed at predetermined conveying speed. As a result, letters and figures are formed on the surface tape 31 as with plural dots. It is to be noted that the tape printing apparatus 1 of the present embodiment can set printing density to either 180 dpi or 360 dpi. In case printing density is set to 180 dpi, there are the following two types of low-density printing methods (1) and (2). (1) In case temperature of the thermal head 41 is under predetermined temperature with the 180 dpi printing density setting, there is carried out low-density dot-expanding printing wherein dots, each occupying width corresponding to two printing lines for 360 dpi, are thermally transferred onto the surface tape 31 to form a dot image. More specifically, the surface tape 31 and the ink ribbon 33 are conveyed by two printing lines at a time in a single printing cycle while heater elements 41*a* to be used for printing based on one line of line printing data are heated. (2) In case temperature of the thermal head 41 is higher than the predetermined temperature with the 180 dpi printing density setting, there is carried out low-density serial printing wherein pairs of dots, each pair of dots being arranged in series, are thermally transferred onto the surface tape 31 to form a dot image. More specifically, the surface tape 31 and the ink ribbon 33 are twice conveyed by one line for 360 dpi, i.e., two lines for 360 dpi in a single printing cycle, while heater elements 41*a* to be used for printing twice in a single printing cycle based on identical one line of line printing data are heated. There will be described on the low-density dot-expanding printing and the low-density serial printing in detail later.

Thereafter, the printed surface tape 31 and the double tape 36 are bonded together along rotation of the conveying roller 22 and the bonding roller 39. As shown in FIG. 5(D), the double tape 36 consists of: a base material layer 84; an adhesive layer 85 formed on one side of the base material layer 84 so as to face the surface tape 31; and a release-paper layer 86 formed on the other side of the base material layer 84. The printed surface tape 31 and the double tape 36 are pressed together by the bonding roller 39 and the conveying roller 22, whereby the double tape 36 is bounded with the printed surface tape 31 via the adhesive layer 85 (refer to FIG. 5(E)). There is consequently formed a laminated tape 38 with the double tape 36 and the surface tape 31 bonded together.

Figure 6:
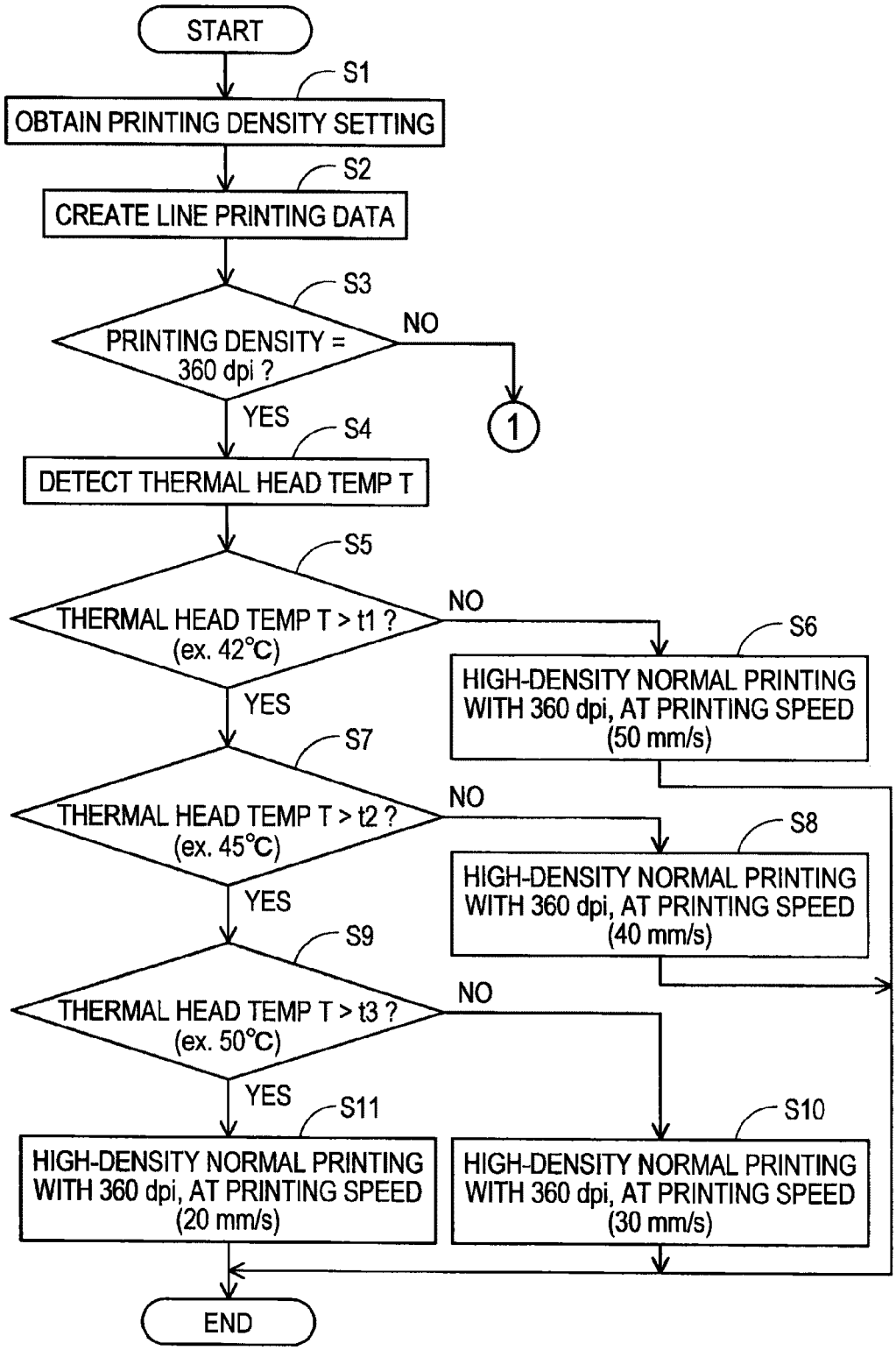
FIG. 6 is a flowchart of a printing process program directed to the embodiment.
Figure 7:
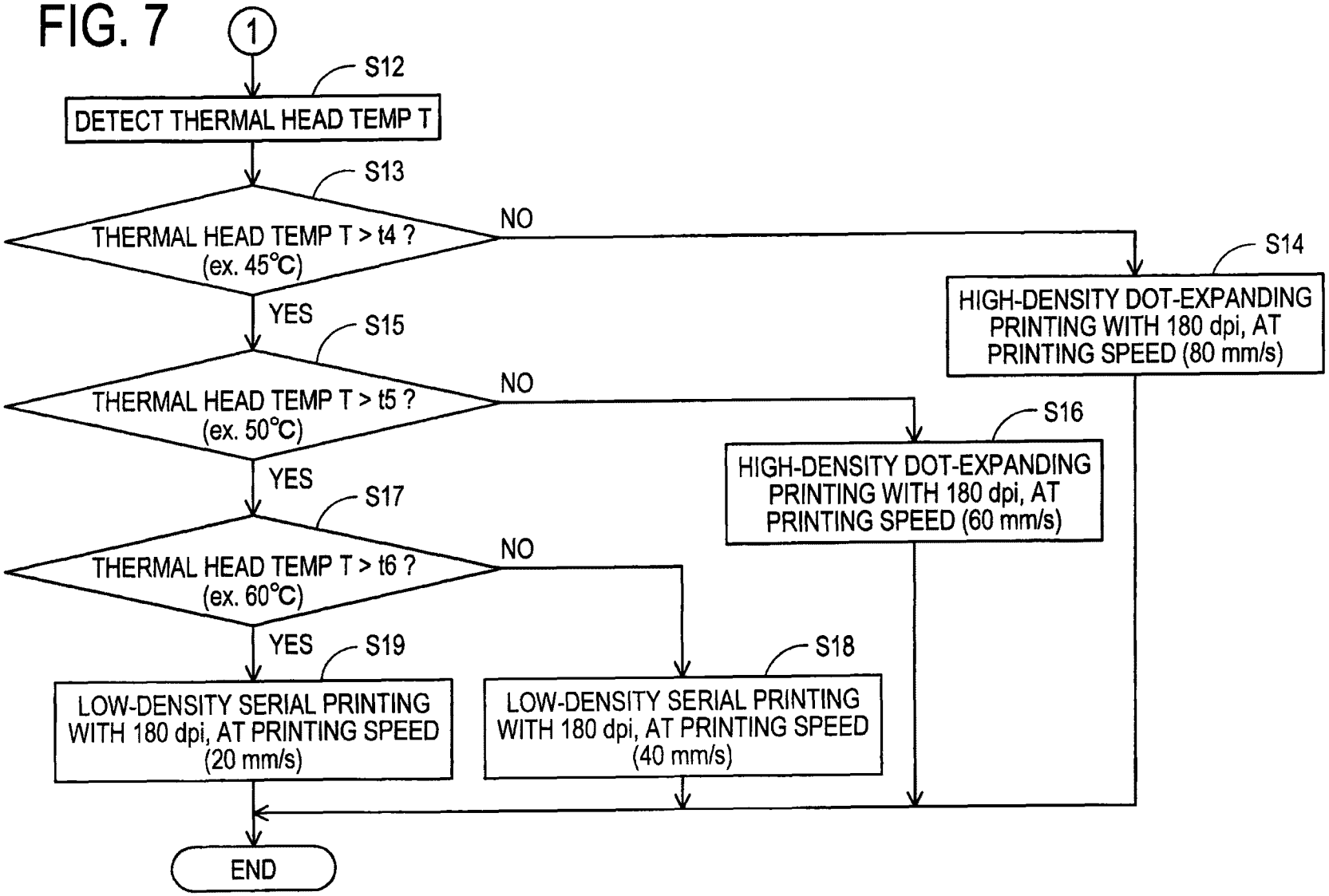
FIG. 7 is a flowchart of a printing process program directed to the embodiment.

Next, there will be described on a printing process program for the tape printing apparatus 1 in detail by referring to drawings. FIG. 6 and FIG. 7 are a set of flowcharts of the printing process program for the tape printing apparatus 1. It is to be noted that the printing process program shown in FIG. 6 and FIG. 7 is executed in the case where the power of the tape printing apparatus 1 is ON and the print key 3B has been depressed on condition that letters and figures to be printed have been inputted based on input operation with the letter input keys 3A. It is to be also noted that the program shown in FIG. 6 and FIG. 7 is stored in the ROM 64, etc. and executed by the CPU 61.

When execution of the printing process program is started, the CPU 61 firstly obtains printing density currently set for the tape printing apparatus 1 at Step (indicated as S hereinafter) 1. It is to be noted that the tape printing apparatus 1 directed to the present embodiment is allowed to set printing density to either 360 dpi (high density) or 180 dpi (low density) by operating the setting key 3E. The printing density currently set for the tape printing apparatus 1 is recorded in the EEPROM 63.

Next, at S2, the CPU 61 creates line printing data for specifying to-be energized heater elements 41*a* and not-to-be-energized heater elements 41*a* of the thermal head 41 with respect to each printing line. More specifically, the CPU 61 creates printing data (image data constituted by dot data) based on a letter string inputted with the letter input keys 3A, printing format previously selected and dot patterns stored in the CD-ROM 62. After that, the CPU 61 creates a plurality of line printing data from the created printing data. To be more specific, each of the plurality of line printing data corresponds to a divided one-line unit of printing data directed to a line of heater elements 41*a* aligned on the thermal head 41. The CPU 61 stores the plurality of line printing data in the RAM 66. In case printing density is set to 360 dpi (high density), the CPU 61 creates a plurality of line printing data to divide an inch into 360 lines. In case printing density is set to 180 dpi (low density), the CPU 61 creates a plurality of line printing data to divide an inch into 180 lines.

Next, at S3, the CPU 61 determines whether or not printing density currently set for the tape printing apparatus 1 is 360 dpi (high density). In case printing density currently set is detected to be 360 dpi (high density) (S3: YES), the CPU 61 shifts the process to S4. On the contrary, in case printing density currently set is detected to be 180 dpi (low density) (S3: NO), the CPU 61 shifts the process to S12.

At S4, the CPU 61 detects temperature T of the thermal head 41 by using the thermistor 73.

Thereafter, at S5, the CPU 61 determines whether or not the temperature T of the thermal head 41 detected by the thermistor 73 at S4 is higher than t1. In this connection, t1 is defined as 42 degrees C., for instance.

In case the temperature T of the thermal head 41 detected by the thermistor 73 is under t1 (S5: NO), the CPU 61 shifts the process to S6.

At S6, the CPU 61 carries out high-density normal printing with printing density of 360 dpi at printing speed of 50 mm/sec. More specifically, the CPU 61 drives the tape conveying motor 2 so as repeatedly carry out the following processes (a) through (c) while conveying the surface tape 31 and the ink ribbon 33 at conveying speed of 50 mm/sec. The processes (a) through (c) are: (a) to read out target line printing data from the RAM 66 wherein one line of printing data corresponds to target line printing data; (b) to transfer the thus read-out target line printing data to the thermal head 41; and (c) to electrically energize heater elements 41*a* to be used for printing among from all the heater elements 41*a* of the thermal head 41 and to convey the surface tape 31 and the ink ribbon 33 by one printing line for 360 dpi with the heater elements 41*a* being heated.

Figure 8:
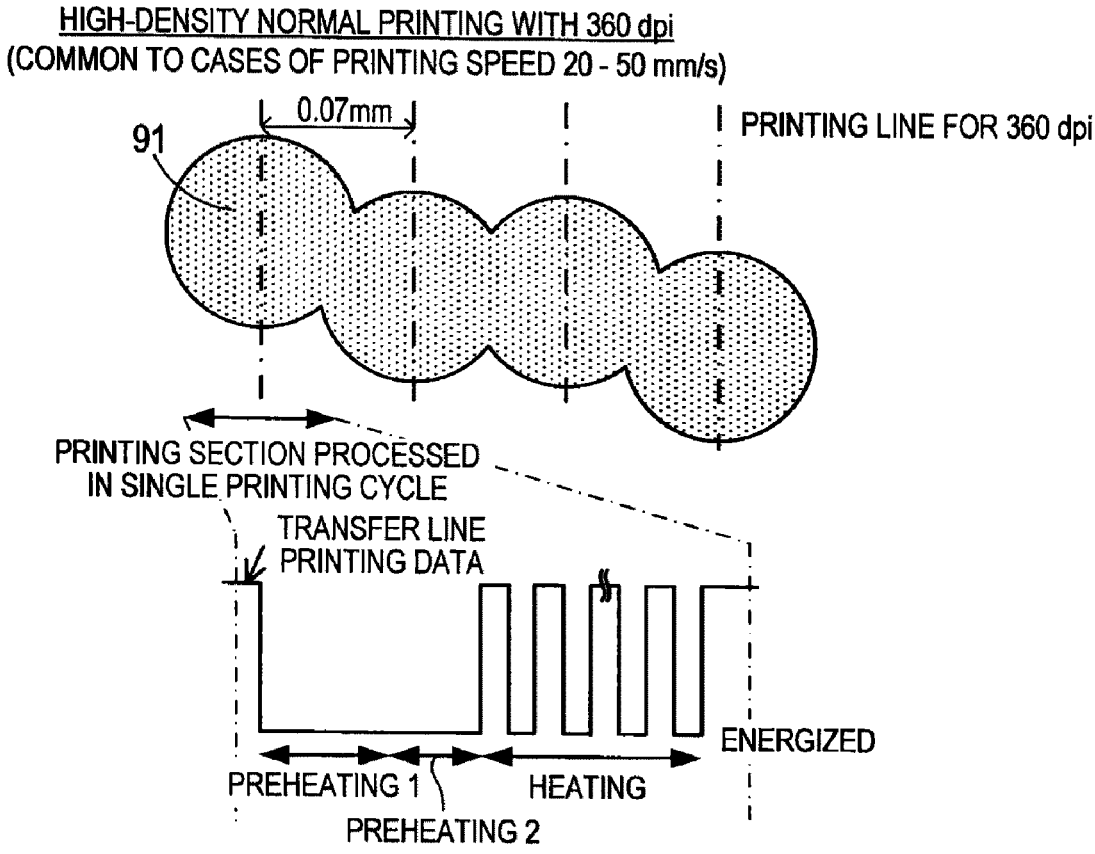
FIG. 8 is a diagram for illustrating a printing process according to high-density normal printing directed to the embodiment.

An energization waveform with respect to a heater element 41*a* for every printing cycle is as shown in FIG. 8. Further, a printing cycle corresponds to time (about 1.41 ms) necessary to move from a printing line to a next printing line, i.e., a space between two printing lines (about 0.07 mm) for 360 dpi, in 50 mm/sec. Consequently, as shown in FIG. 8, a printed dot 91 is thermally transferred onto one printing line for 360 dpi in a single printing cycle.

After finishing printing of all the line printing data constituting the printing data, the CPU 61 finalizes the printing process program. Consequently, printing based on the printing data is applied onto the surface tape 31. The printed surface tape 31 and the double tape 36 are bonded together to form the laminated tape 38. After the laminated tape 38 is conveyed by predetermined length, the tape cutting motor 72 is driven so as to cut off the laminated tape 38 with the fixed blade 17*a* and the rotary blade 17*b*.

On the other hand, in case the temperature T of the thermal head 41 detected by the thermistor 73 is higher than t1 (S5: YES), the CPU 61 shifts the process to S7. Thereafter, at S7, the CPU 61 determines whether or not the temperature T of the thermal head 41 detected by the thermistor 73 is higher than t2. In this connection, t2 is temperature higher than t1 and defined as 45 degrees C., for instance.

In case the temperature T of the thermal head 41 detected by the thermistor 73 is under t2 (S7: NO), namely, in case the temperature T of the thermal head 41 satisfies $t1<T\leqq t2$, the CPU 61 shifts the process to S8.

At S8, the CPU 61 carries out high-density normal printing with printing density of 360 dpi at printing speed of 40 mm/sec. More specifically, the CPU 61 drives the tape conveying motor 2 so as repeatedly carry out the above-described processes (a) through (c) while conveying the surface tape 31 and the ink ribbon 33 at conveying speed of 40 mm/sec.

An energization waveform with respect to a heater element 41*a* is as shown in FIG. 8. Further, a printing cycle corresponds to time (about 1.76 ms) necessary to move from a printing line to a next printing line, i.e., a space between two printing lines (about 0.07 mm) for 360 dpi, in 40 mm/sec. Consequently, as shown in FIG. 8, a printed dot 91 is thermally transferred onto one printing line for 360 dpi in a single printing cycle.

After finishing printing of all the line printing data constituting the printing data, the CPU 61 finalizes the printing process program. Consequently, printing based on the printing data is applied onto the surface tape 31.

On the other hand, in case the temperature T of the thermal head 41 detected by the thermistor 73 is higher than t2 (S7: YES), the CPU 61 shifts the process to S9. Thereafter, at S9, the CPU 61 determines whether or not the temperature T of the thermal head 41 detected by the thermistor 73 is higher than t3. In this connection, t3 is temperature higher than t2 and defined as 50 degrees C., for instance.

In case the temperature T of the thermal head 41 detected by the thermistor 73 is under t3 (S9: NO), namely, in case the temperature T of the thermal head 41 satisfies $t2<T\leqq t3$, the CPU 61 shifts the process to S10.

At S10, the CPU 61 carries out high-density normal printing with printing density of 360 dpi at printing speed of 30 mm/sec. More specifically, the CPU 61 drives the tape conveying motor 2 so as repeatedly carry out the above-described processes (a) through (c) while conveying the surface tape 31 and the ink ribbon 33 at conveying speed of 30 mm/sec.

An energization waveform with respect to a heater element 41*a* is as shown in FIG. 8. Further, a printing cycle corresponds to time (about 2.35 ms) necessary to move from a printing line to a next printing line, i.e., a space between two printing lines (about 0.07 mm) for 360 dpi, in 30 mm/sec. Consequently, as shown in FIG. 8, a printed dot 91 is thermally transferred onto one printing line for 360 dpi in a single printing cycle.

After finishing printing of all the line printing data constituting the printing data, the CPU 61 finalizes the printing process program. Consequently, printing based on the printing data is applied onto the surface tape 31.

On the other hand, in case the temperature T of the thermal head 41 detected by the thermistor 73 is higher than t3 (S9: YES), the CPU 61 shifts the process to S11.

At S11, the CPU 61 carries out high-density normal printing with printing density of 360 dpi at printing speed of 20 mm/sec. More specifically, the CPU 61 drives the tape conveying motor 2 so as repeatedly carry out the above-described processes (a) through (c) while conveying the surface tape 31 and the ink ribbon 33 at conveying speed of 20 mm/sec.

An energization waveform with respect to a heater element 41*a* is as shown in FIG. 8. Further, a printing cycle corresponds to time (about 3.52 ms) necessary to move from a printing line to a next printing line, i.e., a space between two printing lines (about 0.07 mm) for 360 dpi, in 20 mm/sec. Consequently, as shown in FIG. 8, a printed dot 91 is thermally transferred onto one printing line for 360 dpi in a single printing cycle.

After finishing printing of all the line printing data constituting the printing data, the CPU 61 finalizes the printing process program. Consequently, printing based on the printing data is applied onto the surface tape 31.

In case printing density currently set is detected to be 180 dpi (low density) (S3: NO), the CPU 61 shifts the process to S12 and detects temperature T of the thermal head 41 by using the thermistor 73.

Thereafter, at S13, the CPU 61 determines whether or not the temperature T of the thermal head 41 detected by the thermistor 73 at S12 is higher than t4. In this connection, t4 is defined as 45 degrees C., for instance.

In case the temperature T of the thermal head 41 detected by the thermistor 73 is under t4 (S13: NO), the CPU 61 shifts the process to S14.

At S14, the CPU 61 carries out low-density dot-expanding printing with printing density of 180 dpi at printing speed of 80 mm/sec. More specifically, the CPU 61 drives the tape conveying motor 2 so as repeatedly carry out the following processes (d) through (f) while conveying the surface tape 31 and the ink ribbon 33 at conveying speed of 80 mm/sec. The processes (d) through (f) are: (d) to read out target line printing data from the RAM 66 wherein one line of printing data corresponds to target line printing data; (e) to transfer the thus read-out target line printing data to the thermal head 41; and (f) to electrically energize heater elements 41*a* to be used for printing among from all the heater elements 41*a* of the thermal head 41 and to convey the surface tape 31 and the ink ribbon 33 by two printing lines for 360 dpi for a single printing cycle with the heater elements 41*a* being heated.

Figure 9:
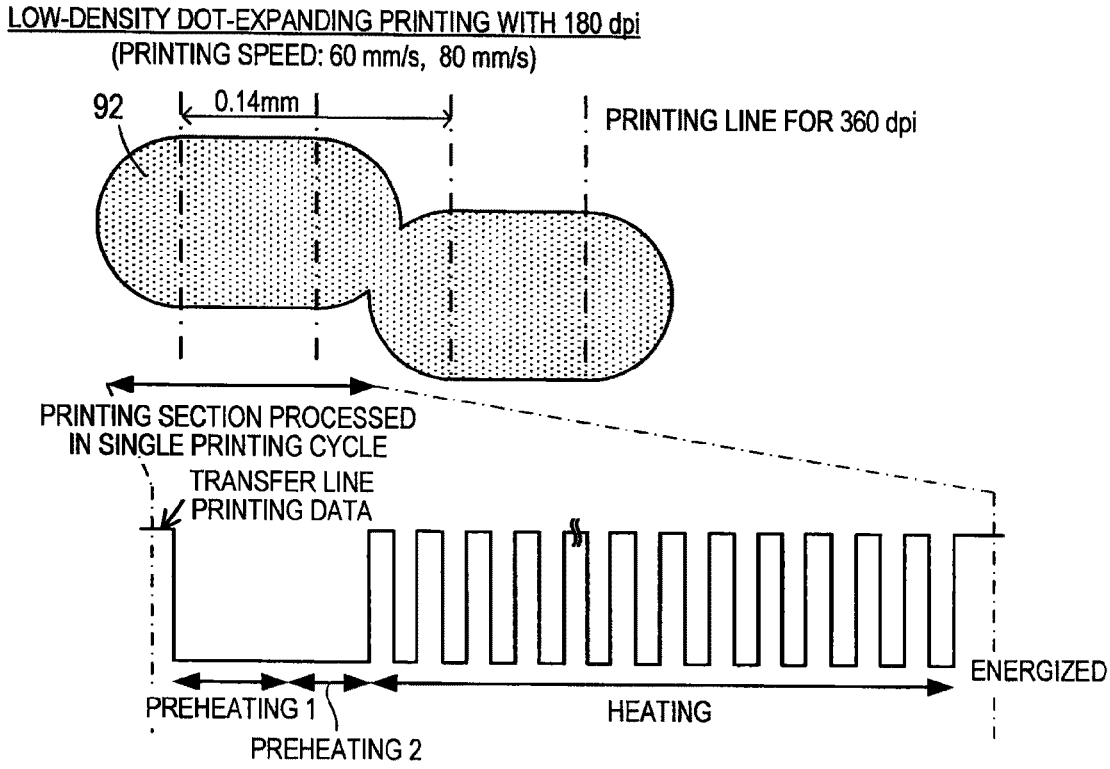
FIG. 9 is a diagram for illustrating a printing process according to low-density dot-expanding printing directed to the embodiment.

An energization waveform with respect to a heater element 41*a* for every printing cycle is as shown in FIG. 9. Further, a printing cycle corresponds to time (about 1.76 ms) necessary to move from a printing line to a next printing line, i.e., a space between two printing lines (about 0.14 mm) for 180 dpi, in 80 mm/sec. Consequently, as shown in FIG. 9, a printed dot 92 is thermally transferred onto two printing lines for 360 dpi in a single printing cycle, wherein the printed dot 92 is a substantially oval shape occupying two printing lines for 360 dpi. In this connection, a printing cycle of low-density dot-expanding printing with 180 dpi takes twice longer than a printing cycle of high-density normal printing (S6, S8, S10 and S11) on condition with the same printing speed.

After finishing printing of all the line printing data constituting the printing data, the CPU 61 finalizes the printing process program. Consequently, printing based on the printing data is applied onto the surface tape 31. The printed surface tape 31 and the double tape 36 are bonded together to form the laminated tape 38. After the laminated tape 38 is conveyed by predetermined length, the tape cutting motor 72 is driven so as to cut off the laminated tape 38 with the fixed blade 17*a* and the rotary blade 17*b*.

On the other hand, in case the temperature T of the thermal head 41 detected by the thermistor 73 is higher than t4 (S13: YES), the CPU 61 shifts the process to S15. Thereafter, at S15, the CPU 61 determines whether or not the temperature T of the thermal head 41 detected by the thermistor 73 at S12 is higher than t5. In this connection, t5 is temperature higher than t4 and defined as 50□, for instance.

In case the temperature T of the thermal head 41 detected by the thermistor 73 is under t5 (S15: NO), namely, in case the temperature T of the thermal head 41 satisfies t4<T≦t5, the CPU 61 shifts the process to S16.

At S16, the CPU 61 carries out low-density dot-expanding printing with printing density of 180 dpi at printing speed of 60 mm/sec. More specifically, the CPU 61 drives the tape conveying motor 2 so as repeatedly carry out the above-described processes (d) through (f) while conveying the surface tape 31 and the ink ribbon 33 at conveying speed of 60 mm/sec.

An energization waveform with respect to a heater element 41*a* for every printing cycle is as shown in FIG. 9. Further, a printing cycle corresponds to time (about 2.35 ms) necessary to move from a printing line to a next printing line, i.e., a space between two printing lines (about 0.14 mm) for 180 dpi, in 60 mm/sec. Consequently, as shown in FIG. 9, a printed dot 92 is thermally transferred onto two printing lines for 360 dpi in a single printing cycle, wherein the printed dot 92 is a substantially oval shape occupying two printing lines for 360 dpi.

After finishing printing of all the line printing data constituting the printing data in the similar manner, the CPU 61 finalizes the printing process program. Consequently, printing based on the printing data is applied onto the surface tape 31.

On the other hand, in case the temperature T of the thermal head 41 detected by the thermistor 73 is higher than t5 (S15: YES), the CPU 61 shifts the process to S17. Thereafter, at S17, the CPU 61 determines whether or not the temperature T of the thermal head 41 detected by the thermistor 73 at S12 is higher than t6. In this connection, t6 is temperature higher than t5 and defined as 60 degrees C., for instance.

In case the temperature T of the thermal head 41 detected by the thermistor 73 is under t6 (S17: NO), namely, in case the temperature T of the thermal head 41 satisfies t5<T≦t6, the CPU 61 shifts the process to S18.

At S18, the CPU 61 carries out low-density serial printing with printing density of 180 dpi at printing speed of 40 mm/sec. More specifically, the CPU 61 drives the tape conveying motor 2 so as repeatedly carry out the following processes (g) through (l) while conveying the surface tape 31 and the ink ribbon 33 at conveying speed of 40 mm/sec. The processes (g) through (l) are: (g) to read out target line printing data from the RAM 66 wherein one line of printing data corresponds to target line printing data; (h) to transfer the thus read-out target line printing data to the thermal head 41; (i) to electrically energize heater elements 41*a* to be used for printing among from all the heater elements 41*a* of the thermal head 41 and to convey the surface tape 31 and the ink ribbon 33 by one printing line for 360 dpi with the heater elements 41*a* being heated; (j) to sequentially read out line printing data identical with the target line printing data at (g) from the RAM 66 as target line printing data; (k) to transfer the thus read-out target line printing data to the thermal head 41; and (l) to electrically energize heater elements 41*a* to be used for printing among from all the heater elements 41*a* of the thermal head 41 and to convey the surface tape 31 and the ink ribbon 33 by one printing line for 360 dpi with the heater elements 41*a* being heated.

Figure 10:
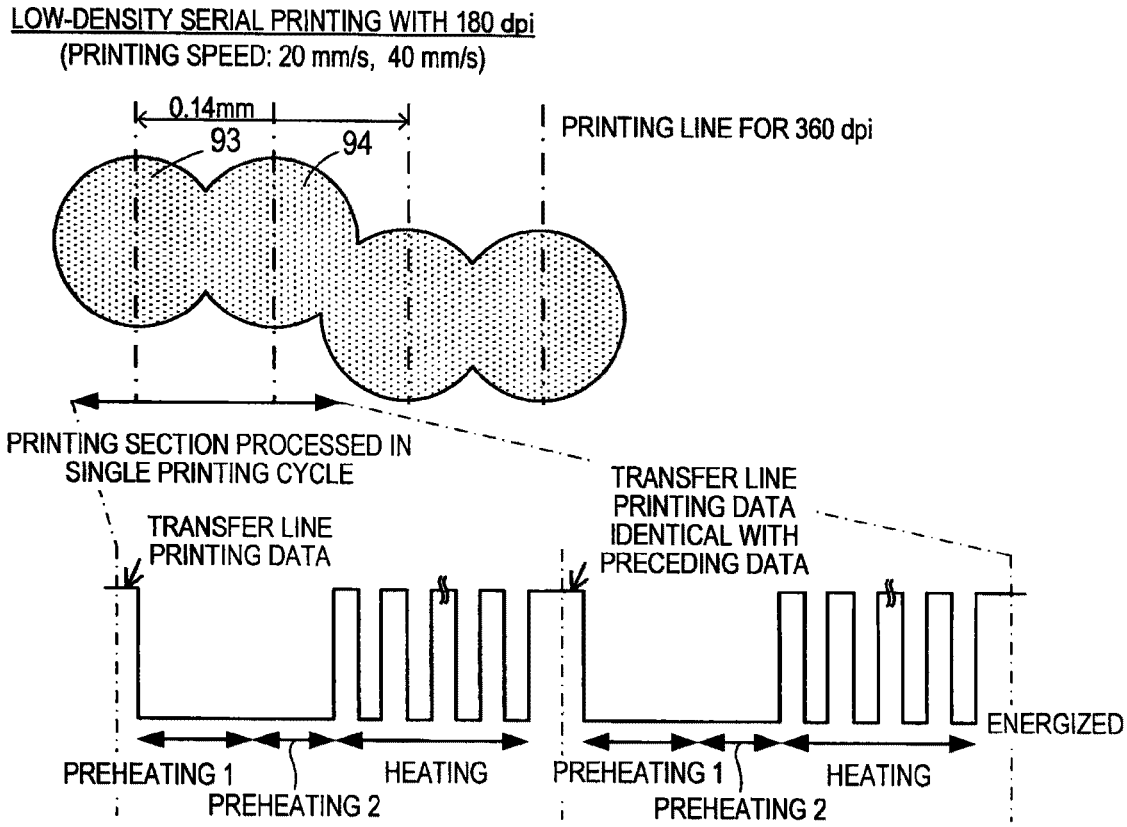
FIG. 10 is a diagram for illustrating a printing process according to low-density serial printing directed to the embodiment.

An energization waveform with respect to a heater element 41*a* for every printing cycle is as shown in FIG. 10. Further, a printing cycle corresponds to time (about 3.52 ms) necessary to move from a printing line to a next printing line, i.e., a space between two printing lines (about 0.14 mm) for 180 dpi, in 40 mm/sec. Consequently, as shown in FIG. 10, a pair of printed dots 93 and 94 are thermally transferred in series onto two printing lines for 360 dpi in a single printing cycle, wherein a shape of jointed and thermally transferred dots 93 and 94 is similar to the printed dot 92 (FIG. 9) which is a substantially oval shape thermally transferred with low-density dot-expanding printing.

After finishing printing of all the line printing data constituting the printing data in the similar manner, the CPU 61 finalizes the printing process program. Consequently, printing based on the printing data is applied onto the surface tape 31. It is to be noted that, among the processes (g) through (l), (j) and (k) may be omitted.

There will be below described the reason why low-density serial printing is carried out in case the temperature T of the thermal head 41 is higher than t5.

That is, when temperature of the thermal head 41 gets high, temperature of the ink ribbon 33 cannot be cooled down sufficiently by the time when the ink ribbon 33 is separated from the after-thermal-transfer surface tape 31. Consequently, ink (ink 83 in FIG. 5(C)) adhered to the surface tape 31 cannot be released therefrom appropriately, which is problematic. In this connection, as the temperature of the thermal head 41 is higher, it gets more easily possible to separate the ink ribbon 33 from the surface tape 31 with the temperature of the ink ribbon 33 cooled down sufficiently. However, in case the above-described low-density dot-expanding printing is carried out at slower printing speed, it is required to keep temperature of the heater element 41*a* at the ink-melting temperature (refer to FIG. 11) or higher for long time and this manner also causes printing quality to deteriorate. Therefore, in case temperature of the thermal head 41 is higher than t5, low-density serial printing is selected and carried out so as to carry out printing without deforming dot shapes considerably.

On the other hand, in case the temperature T of the thermal head 41 detected by the thermistor 73 is higher than t6 (S17: YES), the CPU 61 shifts the process to S19.

At S19, the CPU 61 carries out low-density serial printing with printing density of 180 dpi at printing speed of 20 mm/sec. More specifically, the CPU 61 drives the tape conveying motor 2 so as repeatedly carry out the above-described processes (g) through (l) while conveying the surface tape 31 and the ink ribbon 33 at conveying speed of 20 mm/sec.

An energization waveform with respect to a heater element 41*a* for every printing cycle is as shown in FIG. 10. Further, a printing cycle corresponds to time (about 7.05 ms) necessary to move from a printing line to a next printing line, i.e., a space between two printing lines (about 0.14 mm) for 180 dpi, in 20 mm/sec. Consequently, as shown in FIG. 10, a pair of printed dots 93 and 94 are thermally transferred in series onto two printing lines for 360 dpi in a single printing cycle, wherein a shape of jointed and thermally transferred dots 93 and 94 is similar to the printed dot 92 (FIG. 9) which is a substantially oval shape thermally transferred with low-density dot-expanding printing.

After finishing printing of all the line printing data constituting the printing data, the CPU 61 finalizes the printing process program. Consequently, printing based on the printing data is applied onto the surface tape 31.

As described, in the tape printing apparatus 1 directed to the present embodiment, in the case where the printing density is set to 180 dpi and temperature of the thermal head 41 is under t5 (S13: NO, S15: NO), low-density dot-expanding printing is carried out wherein a dot 92 occupying two printing lines for 360 dpi is formed and thermally transferred onto the surface tape 31 by conveying the surface tape 31 and the ink ribbon 33 by two printing lines for 360 dpi in a single printing cycle with heater elements 41*a* to be used for printing based one line of line printing data being heated (S14, S16). Since letters and figures are consequently formed with thermally-transferred dots each occupying plural lines, quick printing can be carried out without shortening printing cycle with respect to a thermal transfer printer. Accordingly, the tape printing apparatus 1 does not need high-powered design and installation of a high performance CPU. Since the printing of this manner does not create a space between dots, printing quality of the present embodiment does not deteriorate considerably in comparison with the conventional manner to thin out the number of dot.

Further, in the case where temperature of the thermal head 41 is higher than t5 (S17: YES, S17: NO), low-density serial printing is carried out wherein a pair of dots arranged in series on respective lines are formed and thermally transferred onto the surface tape 31 by twice conveying the surface tape 31 and the ink ribbon 33 by one printing line for 360 dpi in a single printing cycle with heater elements 41 to be used for printing twice based on one line of identical printing data being heated (S18, S19). Since letters and figures are consequently formed with thermally-transferred plural dots, dots being paired and each pair of dots being arranged in series, reliable printing quality is secured without considerable deformation of dot shape due to temperature change of the thermal head 41.

As temperature of the thermal head 41 becomes higher, conveying speed of the surface tape 31 and the ink ribbon 33 is made slower. Accordingly, at the time of separating the ink ribbon 33 from printing medium after heating of the ink ribbon 33 with the thermal head 41, it is made possible to separate the ink ribbon 33 from the surface tape 31 with the temperature of the ink ribbon 33 cooled down sufficiently. Accordingly, even if printing is executed continuously or even after printing with considerable number of energized heater elements 41*a* is carried out, ink in the ink layer 82 can be transferred onto a printing medium reliably. Thereby, printing quality is improved.

While presently exemplary embodiments of the present disclosure have been shown and described, it is to be understood that this disclosure is for the purpose of illustration and that various changes and modifications may be made without departing from the scope of the disclosure as set forth in the appended claims.

At the low-density dot-expanding printing (S14, S16) in the present embodiment, a dot 92 occupying two printing lines for 360 dpi is formed and thermally transferred onto the surface tape 31 by conveying the surface tape 31 and the ink ribbon 33 by two printing lines for 360 dpi in a single printing cycle with heater elements 41*a* to be used for printing based one line of line printing data being heated. The surface tape 31 and the ink ribbon 33, however, may be conveyed by three or more printing lines for 360 dpi in a single printing cycle, for instance. In such a case, a dot occupying three or more printing lines is formed and thermally transferred onto the surface tape 31.

Further, at the low-density serial printing (S18, S19) in the present embodiment, a pair of dots arranged in series on respective lines are formed and thermally transferred onto the surface tape 31 by twice conveying the surface tape 31 and the ink ribbon 33 by one printing line for 360 dpi in a single printing cycle with heater elements 41 to be used for printing twice based on one line of identical printing data being heated. The number of times to conveying the surface tape 31 and the ink ribbon 33 by one printing line in a single printing cycle, however, may be three or more times, for instance. In such a case, a set of three or more of dots arranged in series on respective lines are formed and thermally transferred onto the surface tape 31.

Further, printing is applied to the surface tape 31 in the present embodiment. Printing, however, may be applied to the double tape 36 with the surface tape 31 and the printed surface of the double tape 36 being adhered together. Further, the laminated tape 38 may be comprised of only a printed double tape 36 without using the surface tape 31.

In this detailed description, as an example, the disclosure is embodied as a tape printing apparatus wherein printing is carried out onto a tape. The disclosure, however, may be applicable to printing apparatuses of other types as long as they are thermal transfer types.

What is claimed is:

1. A printer comprising:

an ink ribbon that includes an ink layer;

a conveyer unit that conveys a printing medium and the ink ribbon at predetermined conveying speed;

a thermal head that consists of a plurality of heater elements aligned thereon in contact with the ink ribbon, heats up heater elements electrically energized and transfers the ink layer of the ink ribbon directed to positions of the heater elements electrically energized onto the printing medium;

a printing data creator unit that creates printing data;

a printing data divider unit that divides printing data created by the printing data creator unit into plural lines of line printing data specifying to-be-energized heater elements and not-to-be-energized heater elements with respect to the plurality of heater elements;

a data transferor unit that transfers one line of the line printing data to the thermal head;

a temperature detector unit that detects temperature of the thermal head; and a line printing controller unit, wherein, in case the temperature of the thermal head detected by the temperature detector unit is under predetermined temperature, the line printing controller unit controls the conveyer unit to convey the printing medium and the ink ribbon by plural lines while the heater elements electrically energized in accordance with the line printing data transferred by the data transferor unit are in a heated state, wherein, in case the temperature of the thermal head detected by the temperature detector unit is higher than the predetermined temperature, the line printing controller unit controls the conveyer unit to repeat operation to convey the printing medium and the ink ribbon by one line plural times based on identical line printing data while the heater elements electrically energized in accordance with the line printing data transferred by the data transferor unit are in a heated state, and wherein processes by the data transferor unit and the line printing controller unit is repeatedly executed with respect to all the plural lines of the line printing data divided by the printing data divider unit so as to carry out printing on the printing medium based on the printing data.

2. The printer according to claim 1 further comprising a conveying-speed controller unit that controls the conveyer unit to change conveying speed of the printing medium and the ink ribbon depending on the temperature of the thermal head detected by the temperature detector unit.

3. The printer according to claim 2, wherein the conveying-speed controller unit controls the conveyer unit to more slow down the conveying speed of the printing medium and the ink ribbon as the temperature of the thermal head detected by the temperature detector unit gets higher.

4. A printer comprising:

an ink ribbon that includes an ink layer;

a conveyer unit that conveys a printing medium and the ink ribbon at predetermined conveying speed;

a thermal head that consists of a plurality of heater elements aligned thereon in contact with the ink ribbon, heats up heater elements electrically energized and transfers the ink layer of the ink ribbon directed to positions of the heater elements electrically energized onto the printing medium;

a printing data creator unit that creates printing data;

a printing data divider unit that divides printing data created by the printing data creator unit into plural lines of line printing data specifying to-be-energized heater elements and not-to-be-energized heater elements with respect to the plurality of heater elements;

a data transferor unit that transfers one line of the line printing data to the thermal head;

a line printing controller unit that controls the conveyer unit to convey the printing medium and the ink ribbon by plural lines while the heater elements, electrically energized in accordance with the line printing data transferred by the data transferor unit are in a heated state;

wherein, while the conveyer unit conveys the printing medium and the ink ribbon by the plural lines, the line printing controller unit keeps the heated state of the heater elements specified as the to-be-energized heater elements in accordance with the one line of the line printing data transferred by the data transfer unit; and wherein processes by the data transferor unit and the line printing controller unit is repeatedly executed with respect to all the plural lines of the line printing data divided by the printing data divider unit so as to carry out printing on the printing medium based on the printing data.

* * * * *